US008549972B2

(12) United States Patent
Exley

(10) Patent No.: US 8,549,972 B2
(45) Date of Patent: Oct. 8, 2013

(54) FLAT PAPER PUNCH

(75) Inventor: Ross James Exley, Hoboken, NJ (US)

(73) Assignee: EK Success Ltd., Clifton, NJ (US)

( * ) Notice: Subject to any disclaimer, the term of this patent is extended or adjusted under 35 U.S.C. 154(b) by 0 days.

(21) Appl. No.: 13/399,723

(22) Filed: Feb. 17, 2012

(65) Prior Publication Data

US 2012/0227563 A1 Sep. 13, 2012

Related U.S. Application Data

(63) Continuation of application No. 12/291,666, filed on Nov. 12, 2008, now abandoned.

(51) Int. Cl.

| | |
|---|---|
| ***B26F 1/00*** | (2006.01) |
| ***B26D 5/08*** | (2006.01) |
| ***B26D 7/02*** | (2006.01) |

(52) U.S. Cl.
USPC ..... 83/633; 83/459; 30/358

(58) Field of Classification Search
USPC ..... 83/633, 684, 459, 588, 686; 30/358, 30/362–363
See application file for complete search history.

(56) References Cited

U.S. PATENT DOCUMENTS

| | | | | |
|---|---|---|---|---|
| 170,460 | A | 11/1875 | Ashbourne | |
| 1,228,288 | A | 5/1917 | Bower | |
| 1,299,802 | A | 4/1919 | Smith | |
| 1,601,414 | A * | 9/1926 | Purple | 83/563 |
| 2,232,633 | A | 2/1941 | Richardson | |
| 2,780,181 | A | 2/1957 | Roman et al. | |
| 2,799,929 | A | 7/1957 | Kurianski | |
| 4,166,404 | A | 9/1979 | Almog | |
| 4,180,889 | A | 1/1980 | Joffe | |
| D256,479 | S | 8/1980 | Manusch | |
| 4,240,572 | A | 12/1980 | Mitsuhashi | |
| 4,362,497 | A | 12/1982 | Lifshitz | |
| 4,484,390 | A | 11/1984 | Wojtowicz | |
| 4,516,923 | A | 5/1985 | Lifshitz et al. | |
| 4,530,275 | A | 7/1985 | Stickle et al. | |

(Continued)

FOREIGN PATENT DOCUMENTS

| | | | |
|---|---|---|---|
| JP | 58132696 | U | 9/1983 |
| JP | 59082700 | U | 6/1984 |

(Continued)

OTHER PUBLICATIONS

Search Report and Written Opinion for PCT/US2011/039990, Sep. 13, 2011.

*Primary Examiner* — Ghassem Alie
*Assistant Examiner* — Bharat C Patel
(74) *Attorney, Agent, or Firm* — McDermott Will & Emery LLP

(57) ABSTRACT

A punch for punching a sheet of material is provided. The punch has a body with a fissure, a pivot shaft defining a pivot point and a lever retainer secured to said body. The lever is pivotably mounted about the pivot point and has an open position and a closed position. A block is positionable between the lever and the body. The body has longitudinal support ridges and side ridges with the pivot point being positioned in substantially the same plane as the longitudinal support ridge so that when the punch is closed, the side ridges of the lever pass outside of the support ridges of the body in a nesting relationship, allowing the punch to form a flat profile when closed.

15 Claims, 7 Drawing Sheets

(56) References Cited

U.S. PATENT DOCUMENTS

| | | | | |
|---|---|---|---|---|
| D303,812 | S | 10/1989 | Sun | |
| D309,916 | S | 8/1990 | Higashi | |
| 5,005,458 | A | 4/1991 | Merrick | |
| 5,067,242 | A * | 11/1991 | Singer | 30/364 |
| 5,149,594 | A | 9/1992 | Lewandowski et al. | |
| D330,149 | S | 10/1992 | Weimer | |
| 5,251,524 | A * | 10/1993 | Clifford | 83/383 |
| 5,259,750 | A | 11/1993 | Lewandowski et al. | |
| 5,303,473 | A | 4/1994 | Sadler | |
| D373,385 | S | 9/1996 | Birkholz | |
| 5,601,006 | A | 2/1997 | Quinn et al. | |
| 5,660,105 | A | 8/1997 | Benson et al. | |
| D406,606 | S | 3/1999 | Lee | |
| D408,453 | S | 4/1999 | Mori | |
| D415,529 | S | 10/1999 | Mori | |
| 6,089,137 | A * | 7/2000 | Lee | 83/621 |
| 6,194,017 | B1 | 2/2001 | Woodward et al. | |
| 6,209,434 | B1 * | 4/2001 | Kim et al. | 83/549 |
| 6,386,854 | B1 | 5/2002 | Guss | |
| 6,428,248 | B1 * | 8/2002 | Lee | 407/117 |
| 6,513,413 | B2 * | 2/2003 | Lee | 83/633 |
| 6,516,523 | B1 * | 2/2003 | Lin | 30/363 |
| D477,028 | S | 7/2003 | Huang | |
| RE38,219 | E * | 8/2003 | Lee et al. | 83/588 |
| 6,718,641 | B2 | 4/2004 | Hsuan | |
| 6,736,045 | B2 * | 5/2004 | Chang | 83/549 |
| 6,739,244 | B1 * | 5/2004 | Carbaugh | 101/3.1 |
| 6,742,431 | B1 * | 6/2004 | Oh | 83/687 |
| 6,752,058 | B2 * | 6/2004 | Oh | 83/620 |
| 6,874,189 | B2 * | 4/2005 | Ackeret | 7/160 |
| 6,895,842 | B2 | 5/2005 | Magnusson | |
| 6,938,542 | B1 * | 9/2005 | Ho et al. | 101/31.1 |
| 7,011,009 | B1 | 3/2006 | Tomich | |
| D530,991 | S | 10/2006 | West et al. | |
| 7,284,478 | B2 | 10/2007 | Lee | |
| 7,316,555 | B2 | 1/2008 | Hubener | |
| 7,343,854 | B2 | 3/2008 | Nadal-Linares et al. | |
| D615,593 | S * | 5/2010 | Leung | D19/72 |
| 7,882,641 | B2 | 2/2011 | Repac | |
| 2004/0007107 | A1 * | 1/2004 | Bost et al. | 83/13 |
| 2004/0099113 | A1 * | 5/2004 | Hixon et al. | 83/128 |
| 2004/0103772 | A1 * | 6/2004 | Normington | 83/588 |
| 2006/0228955 | A1 | 10/2006 | Rivera | |
| 2007/0006705 | A1 | 1/2007 | Oh | |
| 2007/0051221 | A1 | 3/2007 | Corcoran et al. | |
| 2007/0056422 | A1 * | 3/2007 | Lee | 83/582 |
| 2007/0144359 | A1 | 6/2007 | Ekberg et al. | |
| 2007/0180969 | A1 * | 8/2007 | Kanasashi et al. | 83/684 |
| 2007/0266836 | A1 * | 11/2007 | Marks | 83/684 |
| 2008/0156160 | A1 * | 7/2008 | Yamashita et al. | 83/459 |
| 2008/0282866 | A1 | 11/2008 | Bae | |

FOREIGN PATENT DOCUMENTS

| | | | |
|---|---|---|---|
| JP | 59205300 | A | 11/1984 |
| JP | 60029100 | U | 2/1985 |
| JP | 60103699 | U | 7/1985 |
| JP | 62048497 | A | 3/1987 |
| JP | 62072098 | U | 5/1987 |
| JP | 62188397 | U | 11/1987 |
| JP | 63057099 | U | 4/1988 |
| JP | 01135498 | A | 5/1989 |
| JP | 04115900 | A | 4/1992 |
| JP | 05200699 | A | 8/1993 |
| JP | 06226692 | A | 8/1994 |
| JP | 07227797 | A | 8/1995 |
| JP | 09155795 | A | 6/1997 |
| JP | 09155796 | A | 6/1997 |
| JP | 10076498 | A | 3/1998 |
| JP | 2000042998 | A | 2/2000 |
| JP | 2001157995 | A | 6/2001 |
| JP | 2002001698 | A | 1/2002 |
| JP | 2002001699 | A | 1/2002 |
| JP | 2002331496 | A | 11/2002 |
| JP | 2006082204 | A | 3/2006 |
| JP | 2008110468 | A | 5/2008 |
| JP | 2008246652 | A | 10/2008 |
| JP | 2010280017 | A | 12/2010 |
| JP | 2011045997 | A | 3/2011 |
| WO | 2006198684 | A | 8/2006 |
| WO | WO-2008046076 | A2 | 4/2008 |

* cited by examiner

FLAT PAPER PUNCH

CROSS-REFERENCE TO RELATED APPLICATION

This application is a continuation of U.S. patent application Ser. No. 12/291,666 filed Nov. 12, 2008, which is incorporated herein by reference in its entirety.

TECHNICAL FIELD

This application relates to hole punchers. More particularly, the present invention relates to a compact, flat design punch with improved construction for punching a desired shape into sheet material.

BACKGROUND

A common scrap booking accessory is the manual punch for punching sheet material so that a desired shape may be punched in a sheet material.

An improvement in the field of craft punches are mold pressing devices used to speed the task of punching shapes from paper sheets. Such devices include lever punches which typically have a pressing lever that is pivotally disposed on a seat body for pressing a mold block or palm punches which typically rely on a user's palm to push down in an axial direction on the block in order to create a desired shape on a sheet of paper. With either of these two types of punches, a paper or a sheet can be inserted into or positioned within the fissure of the punch, and then a pressing action is applied to either by pushing the lever with a user's thumb or hand or directly to the block with the user's palm. This causes a mold block to be forced downward, resulting in the die punching a corresponding shape on the paper or the sheet placed in the fissure.

Therefore, using these prior art devices, many products with the shape, as that of the die, can be formed with a typical user having to store each mold pressing device so that when a suitable shape is desired, the appropriate mold pressing device is located and utilized. However, a drawback to a large collection of mold pressing devices, including both lever and palm type punch devices, is their relative bulkiness, leading to a disorganized and disheveled collection of both lever and palm mold pressing devices.

OBJECTS AND SUMMARY

The present invention looks to overcome the drawbacks associated with the prior art by providing an improved flat lever punch design.

A first object is to provide a compact mold punch design such that the internal components of the punch are configured so that the level of the punch can be positioned in a closed position that is substantially parallel to the fissure.

Another object of the invention is to provide a locking assembly so that when the lever is in a closed position, the lock allows the lever to be retained in a closed locked position, allowing the punch to be stored in a convenient and efficient manner, while simultaneously allowing the user to quickly recognize and locate a desired punch within a large group of similar punches.

A further object of the invention is to allow the punch to be stored in an upright manner on a flattened nose surface so that the punch rests in a substantially vertical orientation.

Such an arrangement includes a punch for punching designs into a sheet media, where the profile of the punch is substantially flat. This reduces the size of the punch, making it easier for storage. A lock is positioned between the top/housing and the mold body that keeps the flat shape when not in use.

In one arrangement, the nose of the punch is flattened, so that when not in use, the punch may be punch may be stored vertically—on a work surface, for example—so that a user may easily store and identify the shapes (punched by the punch) by viewing the indicia on the housing.

In another arrangement of the present invention, the mold block of the punch that presses through the body to form the punched shape is fashioned with three shoulders for housing three springs for connecting the mold block to the body in a spring biased relationship. This provides a more stable mold block arrangement and prevents the springs from getting in the way of the housing/punch lever so that the combined punch may retain its flat profile.

To this end, the present invention provides a punch for punching a sheet of material, the punch having a body formed with a fissure for receiving the sheet of material, and a pivot, shaft defining a pivot point. A lever is pivotably mounted about the pivot point of the pivot shaft so that a block may be positionable between the lever and the body. The block is provided with a die movable along a first axis, with the block having first, second, and third shoulders. Each of these shoulders engage first, second, and third resilient members, springs, compression fittings or biasing devices with the resilient members being disposed adjacent to the die and disposed between the first, second, and third shoulders of the block and the body. When the block is positioned between the lever and the body, and when the lever is pivoted about the pivot point between a first open position and a second punched position, the lever engages the block having the axially moveable die to punch the sheet of material.

BRIEF DESCRIPTION OF THE DRAWINGS

The present invention can be best understood through the following description and accompanying drawings, wherein.

DETAILED DESCRIPTION

Figure 3:
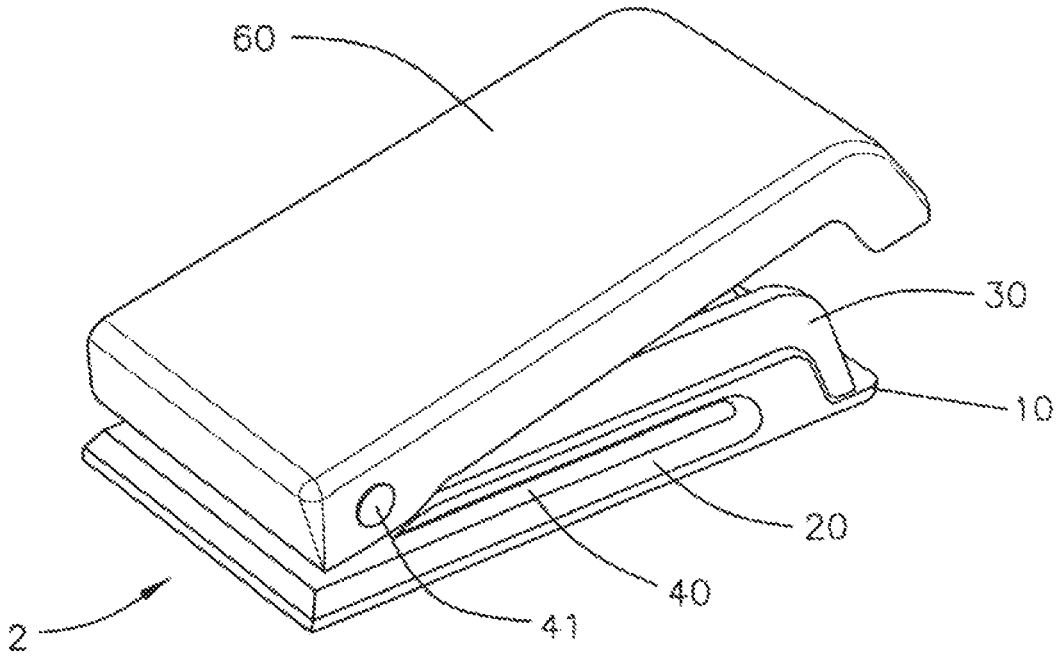
FIG. 3 is a perspective view of a punch device having a punch body as shown in FIG. 1, with the lever thereon, in an open position, in accordance with one embodiment of the present invention.

In one embodiment of the present invention as shown in FIG. 3, a punch body 10 forms the base of a punch device 2.

Punch body 10 has a bottom portion 20, a top portion 30, a lever 60, and a fissure 40 between the top portion 30 and the bottom portion 20.

Figure 1A:
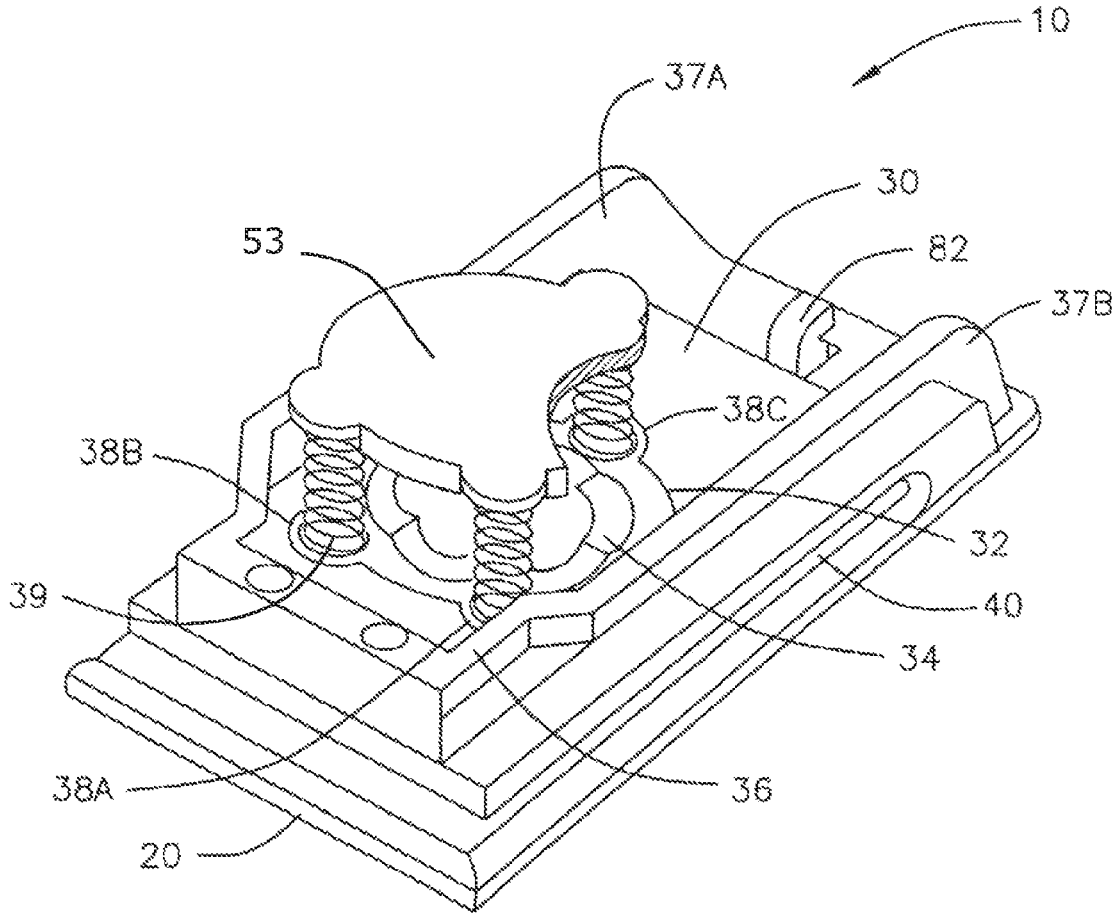
FIG. 1A shows the partially disassembled upper perspective view of the punch body with the lever removed, in accordance with one embodiment of the present invention.
Figure 1B:
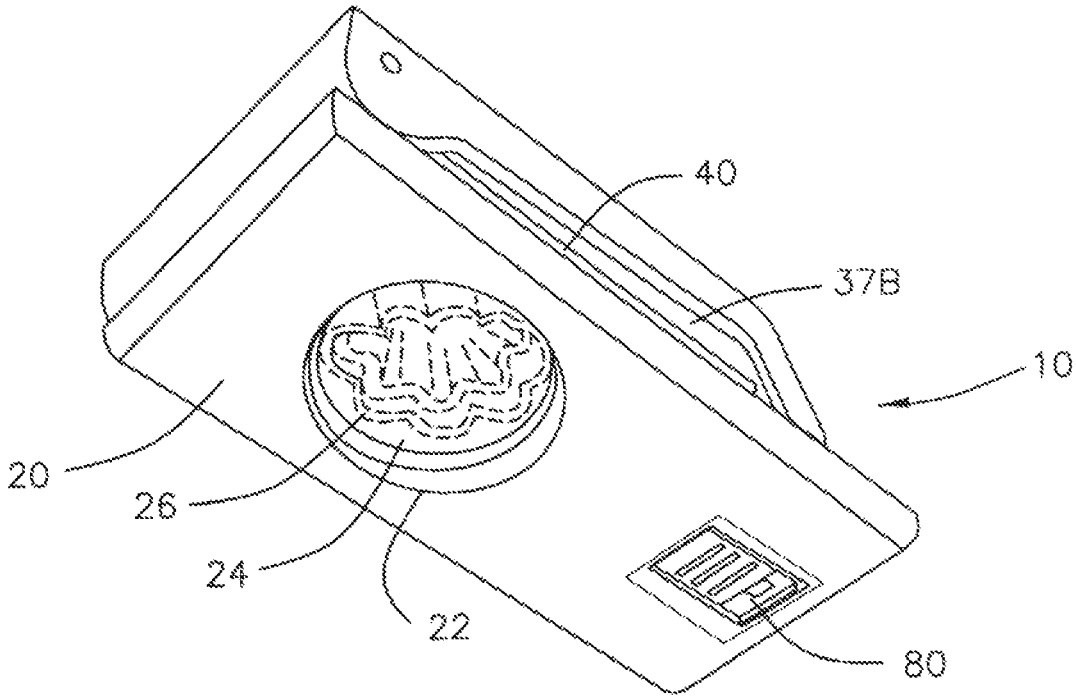
FIG. 1B shows the lower perspective views of the punch body, in accordance with one embodiment of the present invention.

Bottom portion 20 of base 10 forms the primary platform for punch device 2, providing a substantially flat surface to rest punch device 2 on a table or the like. Referring to FIGS. 1A and 1B, bottom portion 20 of base 10 includes an opening 22 configured to support a shaped die 24. Shaped die 24 includes at least one shaped edge 26 that ultimately corresponds to the shape to be cut from a sheet media placed into punch device 2. Although a clover shaped die is shown, it is known to those skilled in the art that any such shaped die may be substituted.

Upper portion 30 of base 10 also includes an opening 32 for supporting a block support element 34. Opening 32 and block support element 34 are substantially aligned over opening 22 and shaped die 24. Block support element 34, preferably made of a metal material, has a shaped opening 36 and three openings 38A, 38B and 38C, each for supporting a resilient member 39 (such as a spring). A pair of structural longitudinal edges 37A and 37B run along the length of upper portion 30 and form the side boundaries of this portion. In one preferable embodiment, longitudinal edges 37A and 37B are spaced apart in this embodiment, approximately 4 centimeters.

As shown in FIG. 1A, openings 38A, 38B and 38C are positioned around the outer circumference of block support element 34. In one advantageous arrangement of the present invention, openings 38A and 38B are located relatively close to one another in the front of upper portion 30 of base 10, close to the opening side of fissure 40, linearly arranged in a manner that is substantially parallel to the front surface of upper and lower portions 30 and 20 of base 10. In one arrangement, opening 38A and 38B are placed substantially about 60 degrees apart from one another.

The final opening 38C is located at the position distal to the front surface of upper and lower portions 30 and 20 of base 10. In one arrangement, opening 38C is substantially 150 degrees separated from either opening 38A and 38B.

As shown in FIGS. 1A and 1B, the thickness and height of upper portion 30 of base 10 is such that it is a substantially flat profile, parallel to lower portion 20. Such an arrangement at least partially provides a basis for the substantially flat profile of punch device 2.

In one embodiment of the present invention as shown in FIGS. 1A and 1B, a locking mechanism 80, such as a slide lock, is accessible from the bottom portion 20 of base 10, with a hook latch 82, connected thereto, which is able to secure lever 60 into a closed position as explained below.

Figure 2:
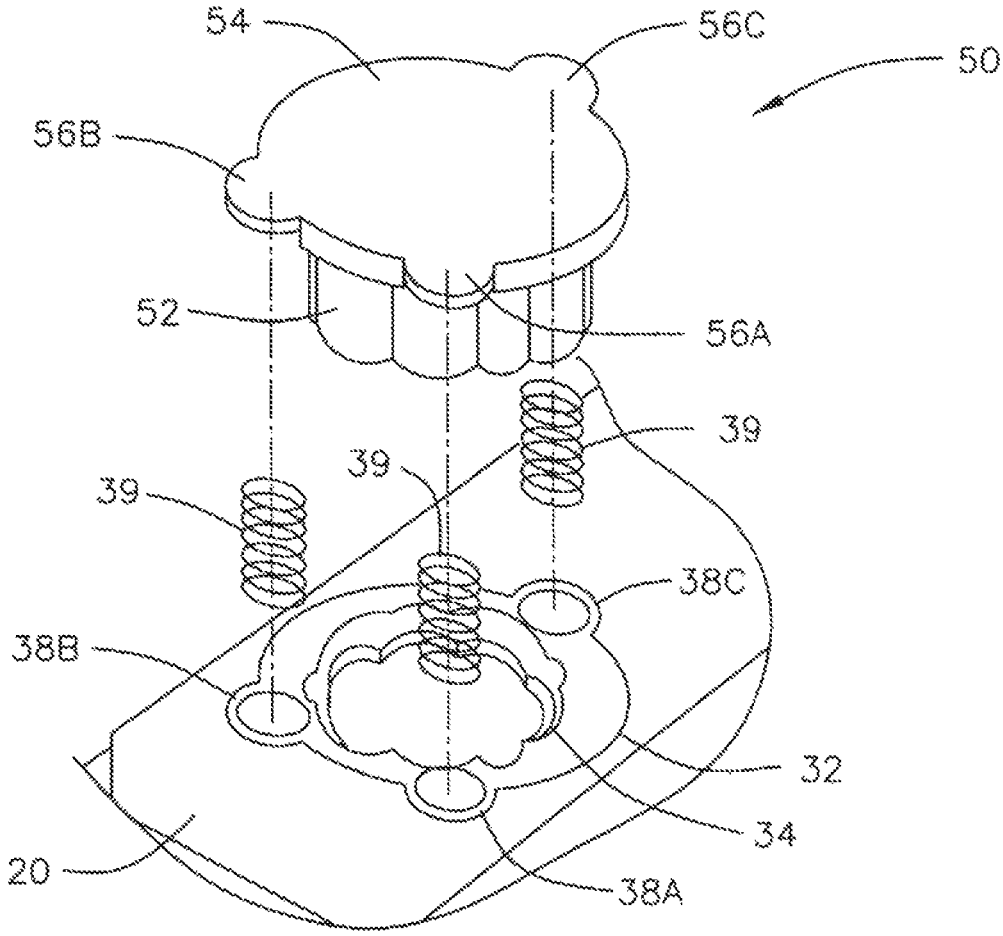
FIG. 2 is a view of the mold block positioned over the opening in the punch body of FIG. 1, in accordance with one embodiment of the present invention.

As shown in FIG. 2, a punch block 50 is shown, in an exploded view of punch device 2, above opening 32 and block support element 34. Block 50 has a shaped punch 52 corresponding to shaped edge 26 of die 24. Shaped punch 52 has a flattened top 54, with three shoulders 56A, 56B and 56C corresponding to openings 38A, 38B and 38C respectively, with shoulder 56A not shown as it is behind shoulder 56B. As shown in FIG. 2, between each opening 38 and shoulders 56, a resilient member 39 is positioned such that punch block 50 is resiliently supported above opening 32 of upper portion 30. As is further shown in FIG. 2, shoulders 56 are elevated relative to flattened top 54 to both receive resilient member 39 and so that the lever 60 may nest within shoulders 56 and make contact with flattened top 54.

Figure 4:
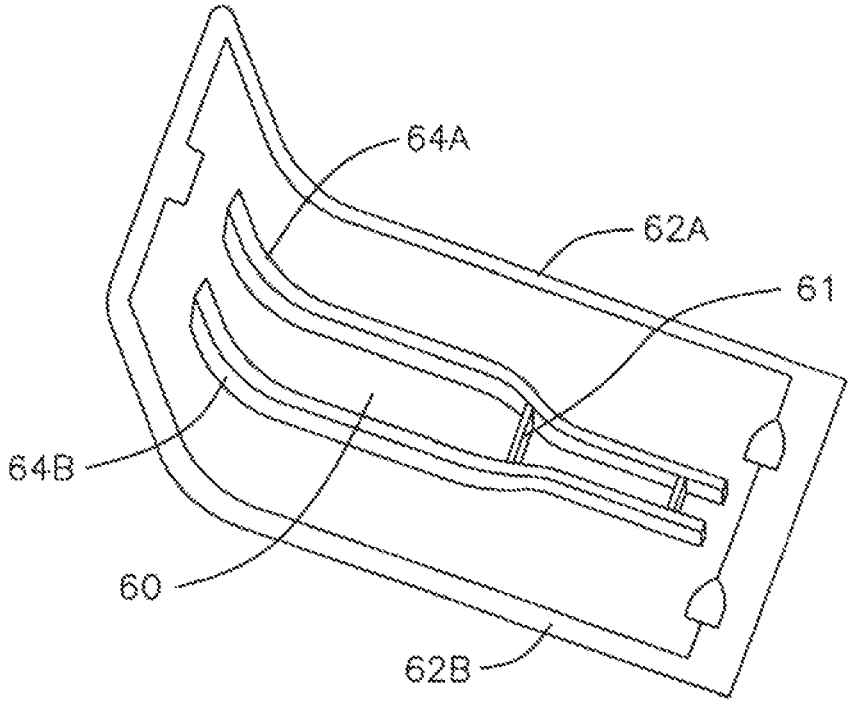
FIG. 4 is a bottom view of the dissembled lever as shown in FIG. 3, in accordance with one embodiment of the present invention.
Figure 5:
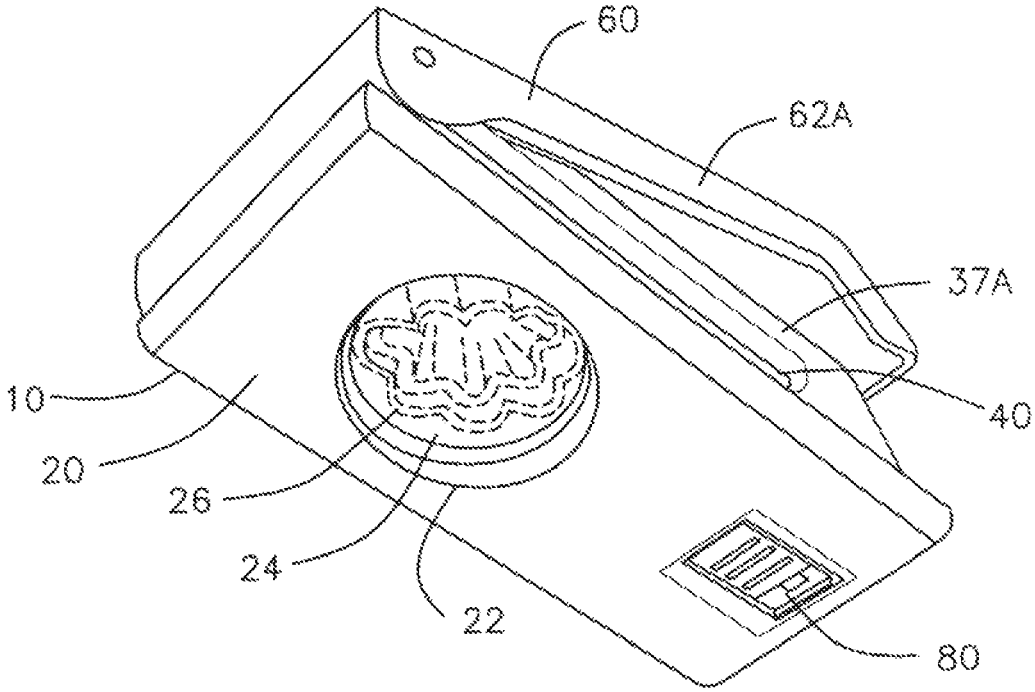
FIG. 5 is a view of the punch device from FIG. 3 in a open position and in accordance with another embodiment of the present invention.

As shown in FIGS. 1A and 1B, as well as FIGS. 3 and 4, a lever 60 is pivotably coupled to the front edge of upper portion 30 of body 10 by pivot attachment means 41, preferably in the form of a metal rod attached transversely across the front end (by fissure 40 opening) of upper portion 30 of body 10. The position of pivot attachment means substantially in the same horizontal plane as longitudinal edges 37A and 37B allows punch 2 to maintain its flat profile by keeping the front (nose) position of lever 60 relatively parallel to body 10. In the open position as shown in FIG. 3, the underside of lever 60 rests on an upper surface 53 of flattened top 54 of punch block 50 and nests within shoulders 56. As described below, underside 61 has a raised bump portion 61 that makes contact with the flattened top 54.

As shown in FIG. 4, lever 60 is generally hollow in shape having two longitudinal support ridges 62A and 62B and a central longitudinal ridge pair 64A and 64B which are closer together towards the front of upper portion 30 (near the pivot coupling 41) and separate for stability as they progress towards the opposite side of upper portion 30. Longitudinal support ridges 62A and 62B are spaced apart so that they may cover and enclose a pair of structural longitudinal edges 37A and 37B, which, as set forth above, have a dimension of approximately 4 centimeters. In one arrangement of the invention, longitudinal support ridges 62A and 62B are spaced apart at a distance slightly greater than 4 cm.

The bottoms of ridges 64A and 64B, at the point where they are close together, rest on flattened top 53 of punch block 50 and form the portion of lever 60, bump 61 that physically contacts upper surface 53 of flattened top 54 of punch block 50.

As shown in FIGS. 3-6, lever 60, along with edges 62 and ridges 64, are preferably profiled in a substantially flat arrangement. In such a manner, when closed, ridges 64 and edges 62 of lever 60 and supports 37 of upper portion 30 pass by one another in a nesting arrangement.

Figure 6:
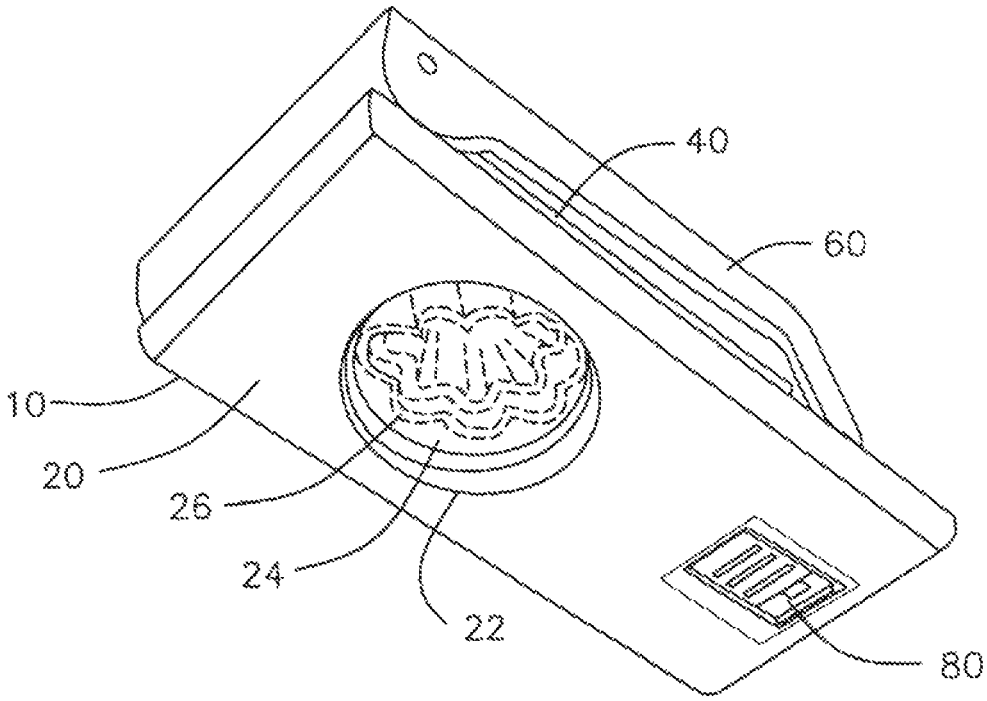
FIG. 6 is a view of the punch device from FIG. 3 in a closed locked position; in accordance with another embodiment of the present invention.

In the closed position shown in FIG. 6, hook 83 of slide latch 80 is engaged so that it connects against a portion of the inside of lever 60 so as to maintain punch 2 in a closed position.

The invention claimed is:

1. A punch for punching a sheet of material, said punch comprising:

a body formed with a fissure for receiving the sheet of material;

a lever having a front portion pivotably mounted to said body and a rear portion opposite said front portion, said lever also including a central longitudinal ridge pair disposed on an underside of the lever and a raised bump positioned between the central longitudinal ridge pair, the central longitudinal ridge pair closer together towards the front portion of the lever and further separated from one another towards the rear portion of the lever;

a block positionable between said lever and said body, said block having a shaped punch movable along a first axis, said block further comprising first, second, and third shoulders; and first, second, and third resilient members, said resilient members disposed adjacent to said die and disposed between said first, second, and third shoulders of said block and said body;

wherein when said block is positioned between said lever and said body, and when said lever is pivoted between a first open position and a second punched position, the bump between the central longitudinal ridge pair on said lever engages said block having said axially moveable shaped punch to punch said sheet of material.

2. The punch of claim 1, wherein said first and second shoulders are positioned approximately 30 degrees about said block from a second axis along the horizontal length of said punch, and wherein said third shoulder is positioned approximately within said second axis.

3. The punch of claim 1, wherein when said lever is pivoted to said second punched position, said lever is substantially parallel to said fissure.

4. The punch of claim 1, further comprising a locking assembly operable to secure said lever in said second punched position, such that said lever is locked in a closed position parallel to said fissure.

5. The punch of claim 1, wherein said body further comprises a front nose portion, said front nose portion having a flattened surface so that when said punch is locked in said closed position and positioned upright in a stored position on said flattened surface, said punch rests in a substantially vertical orientation.

6. The punch of claim 1, wherein said body includes longitudinal support edges and said lever includes side ridges, wherein when said punch is closed, said side ridges of said lever pass outside of said support edges of said body in a nesting relationship, allowing said punch to form a flat profile when closed.

7. The punch of claim 1, wherein said block has a flat upper surface above said die, and wherein said shoulders are raised relative to said flat upper surface.

8. The punch of claim 7, wherein said first and second shoulders are positioned substantially 60 degrees apart from one another and each substantially 150 degrees apart from said third shoulder.

9. The punch of claim 7, wherein said longitudinal ridge pair is configured to be separate around said third shoulder, and tapers together towards said front portion to pass between said first and second shoulders.

10. The punch of claim 7, wherein said longitudinal ridge pair is configured to be separate around said third shoulder, and tapers together towards said front portion to pass between said first and second shoulders, allowing said lever to engage said block in a manner that allows said punch to form a flat profile when closed.

11. A punch for punching a sheet of material, said punch comprising:

a body formed with a fissure for receiving the sheet of material;

a lever pivotably mounted to said body for pivotal movement about a pivot point, said lever having an open position in which one end of said lever is elevated to a height above said pivot point, and said lever having a closed position in which said lever is positioned parallel to said fissure, said lever also including a central longitudinal ridge pair disposed on an underside of the lever and a raised bump positioned between the central longitudinal ridge pair, the longitudinal ridge pair closer together towards a front portion of the lever and further separated from one another towards a rear portion of the lever;

a locking mechanism operable to secure said lever in the closed position;

a block positionable between said lever and said body, said block having a shaped punch movable along a first axis, said block further comprising a seat configured to receive said lever; and at least one resilient member adjacent to said die, and disposed between said block and said body, wherein when said block is positioned between said lever and said body and when said lever is pivoted about said pivot point between a first and a second point, the bump between said longitudinal rib pair engages said block having said axially movable shaped punch to punch said sheet of material, wherein said body further comprises longitudinal support edges and said lever further comprises side ridges, and wherein when said punch is closed, said side ridges of said lever pass outside of said support edges of said body in a nesting relationship, allowing said punch to form a flat profile when closed.

12. The punch of claim 11, wherein the longitudinal support edges are located in substantially the same horizontal plane as said pivot point.

13. The punch of claim 12, wherein said block has a flat upper surface above said die, and comprises first, second, and third shoulders, wherein said shoulders are raised relative to said flat upper surface.

14. The punch of claim 13, wherein said first and second shoulders are positioned substantially 60 degrees apart from one another and each substantially 150 degrees apart from said third shoulder.

15. The punch of claim 14, wherein said longitudinal ridge pair contacts said upper surface of said die, wherein said longitudinal ridge pair is configured to be separate around said third shoulder, and tapers together towards said front portion to pass between said first and second shoulders.

* * * * *